US006597334B1

(12) United States Patent
Nakamura

(10) Patent No.: US 6,597,334 B1
(45) Date of Patent: Jul. 22, 2003

(54) DRIVING METHOD OF PLASMA DISPLAY PANEL

(75) Inventor: Tadashi Nakamura, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/377,736

(22) Filed: Aug. 19, 1998

(30) Foreign Application Priority Data

Aug. 19, 1998 (JP) ..... 10-233170

(51) Int. Cl.[7] ..... G09G 3/28
(52) U.S. Cl. ..... 345/68; 345/60; 345/63
(58) Field of Search ..... 345/60, 67, 68, 345/69, 70, 208; 315/169.1, 169.4

(56) References Cited

U.S. PATENT DOCUMENTS 5,854,540 A * 12/1998 Matsumoto et al. ..... 315/169.1
5,943,031 A * 8/1999 Tokunaga et al. ..... 315/169.4
5,963,184 A * 10/1999 Tokunaga et al. ..... 315/169.4
5,995,069 A * 11/1999 Tokunaga et al. ..... 345/208
6,037,916 A * 3/2000 Amemiya ..... 345/60
6,084,559 A * 7/2000 Nagao et al. ..... 345/67
6,100,859 A * 8/2000 Kuriyama et al. ..... 345/68
6,262,699 B1 * 7/2001 Suzuki et al. ..... 345/68

FOREIGN PATENT DOCUMENTS

JP 49-115242 11/1974
JP 9-6280 1/1997
JP 9-22271 1/1997

OTHER PUBLICATIONS

Nakamura, et. al., "Drive for 40–in. –Diagonal Full–Color ac Plasma Display", SID 95 Digest, vol. XXVI, pp. 807–810.

Japanese Office Action dated Nov. 15, 2000 with partial English translation.

* cited by examiner

*Primary Examiner*—Bipin Shalwala
*Assistant Examiner*—David L. Lewis
(74) *Attorney, Agent, or Firm*—McGinn & Gibb, PLLC

(57) ABSTRACT

Immediately before a supply of a sequential scan pulse Pw to respective scan electrodes in a write discharge period B, an auxiliary scan pulse Phw opposite in polarity to the scan pulse is applied thereto. Immediately after the application of the scan pulse Pw, a sustaining pulse Ps1 is applied to the scan electrode and a sustaining pulse Pu1 opposite in polarity to the sustaining pulse Ps1 is sequentially supplied to the sustaining electrodes correspondingly to the sustaining pulse Ps1. The sustaining pulses Ps1 and Pu1 are continuously supplied to the scan electrodes and the sustaining electrodes to a time close to a start of a second sustaining pulse. By obtaining a stable write discharge and an improved transition to the sustaining discharge in a matrix type plasma display panel, it is possible to obtain a large display capacity and a wide driving voltage range.

18 Claims, 8 Drawing Sheets

DRIVING METHOD OF PLASMA DISPLAY PANEL

BACKGROUND OF THE INVENTION

1. Field of the Invention

The present invention relates to a driving method of a plasma display panel and, particularly, to a driving method of a plasma display panel, which performs a matrix display of an A.C. discharge type.

2. Description of Related Art

In general, the plasma display panel (referred to as "PDP", hereinafter) has several advantageous features. That is, for example, the PDP has a thin structure and a large contrast ratio of display without flicker. Further, the PDP allows a screen size to be made relatively large and its response speed is high. In addition, the PDP emits light spontaneously and is capable of emitting multi-color light by utilizing suitable fluorescent materials. Therefore, the PDP has been becoming more popular in the fields of display related to computers and color picture displays, etc.

Depending upon the operating system of the PDP, the driving method of such PDP is roughly classified to an A.C. discharge type and a D.C. discharge type. In the A.C. discharge type PDP, a dielectric member covers electrodes and the PDP is operated indirectly in an A.C. discharge state. In the D.C. discharge type PDP, electrodes are exposed to a discharge space and the PDP is operated in a D.C. discharge state. The A.C. discharge type PDP is further classified to those of a memory operating type, which utilizes memories of discharge cells as its driving system, and a refresh operating type, in which discharge cell memories are not utilized. Incidentally, luminance of the PDP is proportional to the number of discharges, that is, the repetitive number of pulse voltage. In the case of the above mentioned refresh type PDP, the larger the display capacity provides the lower the luminance. Therefore, PDP of the refresh operation type is mainly used for those having small display capacity.

FIG. 1 is a perspective view of an example of a construction of one of display cells 16 of the A.C. discharge, memory operation type PDP in a disassembled state. The display cell 16 is composed of a front and rear insulating substrates 1 and 2 both formed of glass material, a transparent scan electrode 3 formed on a lower surface of the insulating substrate 2, a transparent sustaining electrode 4 also formed on the lower surface of the insulating substrate 2, trace electrodes 5 and 6 arranged on the scan electrode 3 and the sustaining electrode 4, respectively, in order to reduce electrode resistance thereof, a data electrode 7 formed on an upper surface of the insulating substrate 1 and extending perpendicularly to both the scan electrode 3 and the sustaining electrode 4, a discharge gas space 8 defined by the insulating substrates 1 and 2 and partition walls 9, which define the display cell, and filled with discharge gas such as helium, neon or xenon or a mixture thereof, a fluorescent material 11 for converting ultra-violet ray generated by discharge of the discharge gas into a visible light 10, a dielectric member 12 covering the scan electrode 3 and the sustaining electrode 4, a protective layer 13 of such as magnesium oxide for protecting the dielectric member 12 against discharge and a dielectric member 14 covering the data electrode 7.

Describing a discharge operation of the selected one of the display cells 16 shown in FIG. 1, when discharge of gas in the discharge gas space 8 is started by applying a pulse voltage exceeding a discharge threshold value of discharge gas between the scan electrode 3 and the data electrode 7, positive and negative charges are attracted to surfaces of the oppositely arranged dielectric members 12 and 14, respectively, correspondingly to the polarity of the pulse voltage and accumulated thereon. An equivalent internal voltage caused by the accumulated electric charges, that is, a wall voltage, is opposite in polarity to the applied pulse voltage. Therefore, an effective voltage inside the display cell is lowered with growth of the discharge, so that it becomes impossible to sustain the discharge and the discharge is terminated even if the applied pulse voltage is held at a constant value. When a sustaining pulse voltage, which is the same in polarity as the wall voltage, is applied between the scan electrode 3 and the sustaining electrode 4, a portion of the sustaining pulse voltage, which corresponds to the wall voltage, is overlapped as an effective voltage. Therefore, it is possible to provide discharge with a discharge voltage exceeding the discharge threshold value even if a voltage level of the sustaining pulse is low. As a consequence of this fact, it becomes possible to sustain the discharge by continuously applying the sustaining pulse voltage across the scan electrode 3 and the sustaining electrode 4. This function is the memory operation of the A.C. discharge type PDP mentioned previously. Applying a wide and low voltage pulse or an erase pulse, which can neutralize the wall voltage, to the scan electrode 3 or the sustaining electrode 4, can terminate the above sustaining discharge. The erase pulse may be a narrow pulse having a voltage amplitude as small as that of the sustaining pulse.

FIG. 2 is a plan view schematically showing a PDP 15 formed by arranging the display cells 16 each shown in FIG. 1 in matrix. In FIG. 2, the PDP 15 takes in the form of a panel constituted by arranging the display cells 16 in a matrix of n rows and m columns. The PDP 15 includes scan electrodes Sw1, Sw2, . . . , Swn and sustaining electrodes Su1, Su2, . . . , Sun, which are arranged in parallel to each other, as the row electrodes and data electrodes D1, D2, . . . , Dm, which are orthogonal to the scan electrodes and the sustaining electrodes, as the column electrodes.

FIG. 3 shows driving pulse waveforms for illustrating a conventional drive method of the PDP shown in FIGS. 1 and 2. This driving method is equivalent to that proposed in "Society for Information Display International Symposium Digest of Technical Papers", Vol. XXVI (pp. 807–810) and this driving method will be referred to as "first prior art example", hereinafter.

In FIG. 3, Wu depicts a waveform of a sustaining electrode driving pulse, which is commonly applied to the sustaining electrodes Su1, Su2, . . . , Sun, Ws1, Ws2, . . . , Wsn depict waveforms of scan electrode driving pulses applied to the respective scan electrodes Sw1, Sw2, . . . , Swn, respectively, and Wd depicts a waveform of a data electrode driving pulse selectively applied to one of the data electrode Di ($1 \leqq i \leqq m$). One driving period (1 frame) is constituted with a pre-discharge period A, a write discharge period B and a sustaining discharge period C and a desired image display is obtained by repeating this driving period.

The pre-discharge period A is provided in order to produce active charges particles and wall charges in the discharge gas space to thereby obtain a stable write discharge characteristics in the write discharge period B. In the pre-discharge period A, a pre-discharge pulse Pp for preliminarily discharging all display cells of the PDP 15 is applied to all of the sustaining electrodes and then a pre-discharge erase pulse Ppe for extinguishing electric charges among the wall charges produced in the pre-discharge period A, which block the write discharge and the sustaining discharge, is applied to all of the respective scan electrodes, simultaneously. That is, the discharge is produced in all of the display cells by applying the pre-discharge pulse Pp to the sustaining electrodes Su1, Su2, . . . , Sun, first, and, thereafter, the erase discharge is produced by applying the erase pulse Ppe to the scan electrodes Sw1, Sw2, . . . , Swn to erase the wall charges accumulated by the pre-discharge pulse Pp.

A scan base pulse Pbw is commonly applied to the respective scan electrodes Sw1, Sw2, . . . , Swn throughout the write discharge period B. Further, in the write discharge period B, a sequentially scan pulse Pw is sequentially supplied to the scan electrodes and a data pulse Pd is selectively supplied to the data electrode Di ($1 \leqq i \leqq m$) of the display cell to be displayed, in synchronism with the application of the scan pulse Pw, to produce a write discharge in the display cell to thereby produce the wall charges.

The scan base pulse Pbw commonly applied to the scan electrodes throughout the write period B is used to prevent the wall charges necessary for shifting the write discharge to the sustaining discharge from being lost due to an erase discharge, which is produced by the internal voltage of the display cell due to the wall charges and the large amount of active charged particles existing within the space at a time when the scan pulse Pw and the data pulse Pd disappear.

In the sustaining discharge period C, sustaining discharge necessary to obtain a desired brightness of the display cells, which perform the write discharge in the write discharge period B, is sustained by applying a first sustaining pulse Pu to the sustaining electrodes and applying a second sustaining pulse Ps having a phase delayed from the sustaining pulse Pu by 180° to the scan electrodes.

Since, in the PDP driving system shown as the first prior art example, the pre-discharge period, the write discharge period and the sustaining discharge period are completely separated in time from each other, a time from the pre-discharge to the write discharge is different from a time from the write discharge to the sustaining discharge every scan line. Therefore, for first scan lines closest in time to the pre-discharge, an attenuation of the space charge after the preparatory discharge is distinguished is small and, therefore, the write discharge occurs easily. However, since the time from the write discharge to the sustaining discharge is relatively long, there is a problem that the wall charge produced by the write discharge is reduced gradually before the sustaining discharge is started, so that the smoothness of transition from the write discharge to the sustaining discharge is degraded. On the contrary, for subsequent scan lines, the time from the write discharge to the sustaining discharge is relatively short and, therefore, there is substantially no degradation of the smoothness of transition from the write discharge to the sustaining discharge due to extinction of the wall charge produced by the write discharge. However, there is another problem that, since the time from the pre-discharge to the write discharge is long, the attenuation of the space charge after the pre-discharge is distinguished is considerable and the write discharge can not occur easily.

SUMMARY OF THE INVENTION

An object of the present invention is to provide a stable driving method of an A.C. discharge type PDP of matrix type.

Another object of the present invention is to provide a stable driving method of an A.C. discharge type PDP of matrix type, in which a transition from a write discharge to a sustaining discharge is improved by enhancing and stabilizing the write discharge by applying an auxiliary scan pulse opposite in polarity to a scan pulse to display cells of the PDP immediately before the scan pulse is applied thereto and by applying a first sustaining pulse immediately after the write discharge and sustaining it until a second sustaining pulse is started.

A further object of the present invention is to realize a display device having a large display capacity by providing a driving method of an A.C. discharge type PDP of matrix type, in which an auxiliary scan pulse opposite in polarity to a scan pulse to scan electrodes immediately before the scan pulse is applied to the scan electrodes to produce a state in which gas discharge can be easily produced, that is, a state in which a probability of occurrence of a write discharge is high, to thereby reduce a variation of discharge delay time and to shorten a time necessary for a write of respective scan lines, so that it becomes possible to drive a larger number of scan lines within a constant time.

Another object of the present invention is to widen a driving voltage range of an A.C. discharge type PDP of matrix type by providing a driving method thereof, in which a sustaining pulse immediately after the write discharge is applied to the scan electrode and the sustaining pulse is sustained till a time close to a start time of a next sustaining pulse, to smooth transition from the write discharge to a first sustaining discharge and transition from the first sustaining discharge to a second sustaining discharge, to thereby make possible to start the sustaining discharge even with a low sustaining voltage.

According to a first aspect of the present invention, a driving method of an A.C. discharge type PDP of a matrix type, which is constructed with a plurality of display cells including a plurality of row electrode pairs each including a scan electrode and a sustaining electrode and a plurality of data electrodes arranged in a direction orthogonal to the row electrode pairs and constituting column electrodes, comprises the steps of applying, in a pre-discharge period, a pre-discharge pulse to the scan electrodes and the sustaining electrodes simultaneously in a pre-discharge period, supplying an erase pulse for erasing wall charges accumulated by the pre-discharge pulse to the respective sustaining electrodes to produce an erase discharge, in a write discharge period, sequentially applying an auxiliary scan pulse opposite in polarity to the scan pulse to the scan electrodes immediately before an application of a sequential scan pulse to the respective scan electrodes, applying the scan pulse to the respective scan electrodes sequentially and applying a data pulse to the data electrodes selectively in synchronism with the scan pulse.

By sequentially supplying the auxiliary scan pulse opposite in polarity to the scan pulse to the scan electrodes immediately before the application of the sequential scan pulse to the respective scan electrodes, space charges, which are the same in polarity to a write voltage, are attracted such that an electric field in the display cell is cancelled out. Therefore, the electric field in the display cell is further increased when the scan pulse is supplied thereto, so that it is possible to produce a state in which the write discharge is easily produced. Consequently, the stability of the write discharge is improved.

According to a second aspect of the present invention, a driving method of an A.C. discharge type PDP of matrix type comprises, in the write discharge period, the steps of sequentially applying a scan pulse to the respective scan electrodes, applying a first sustaining pulse and an opposite sustaining pulse opposite in polarity to the first sustaining pulse to the scan electrodes and the sustaining electrode, respectively, immediately after the application of the scan pulse to the scan electrodes and sustaining these sustaining pulses till a time close to an application of a second sustaining pulse. According to this method, since the application of the sustaining pulse is started while the wall charges and the space charges provided by the write discharge are not extinguished substantially, the transition from the write discharge to the first sustaining discharge during the sustaining discharge period becomes improved.

According to a third aspect of the present invention, the first and second driving methods are combined in order to stabilize the write discharge by means of an auxiliary scan pulse and to make the transition from the write discharge to the sustaining discharge smooth by means of the sustaining pulse applied immediately after the application of the scan pulse, to thereby obtain a more stable driving of the PDP.

DETAILED DESCRIPTION OF THE PREFERRED EMBODIMENTS

Preferred embodiments of the present invention will be described with reference to the accompanying drawings.

Figure 1:
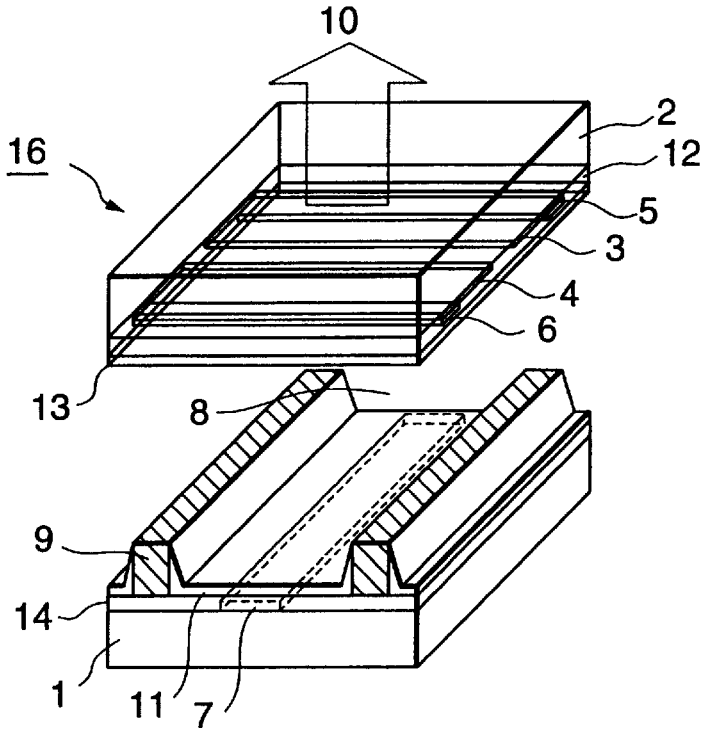
Fig.1 Prior Art
FIG. 1 is a schematic perspective view of one of display cells of a conventional PDP.
Figure 2:
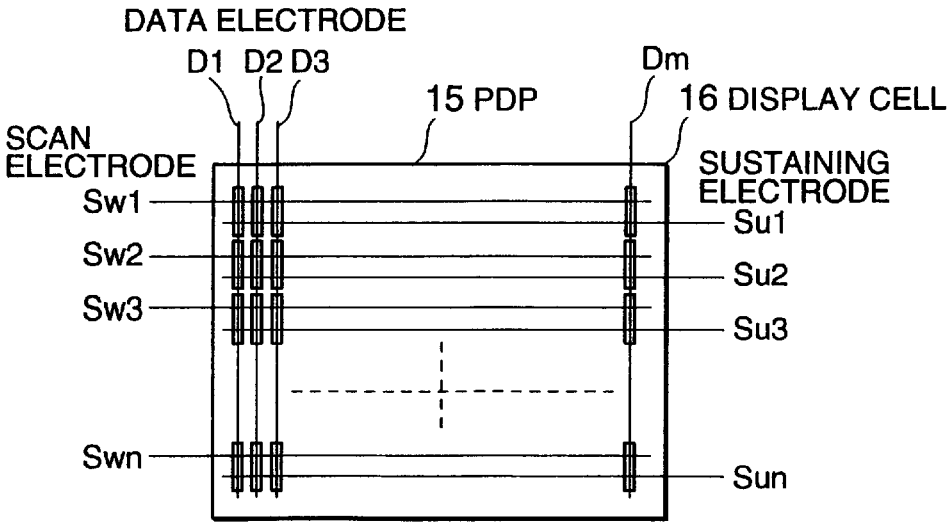
Fig.2 Prior Art
FIG. 2 is a schematic plan view of the PDP having a matrix arrangement of the display cells each shown in FIG. 1.
Figure 3:
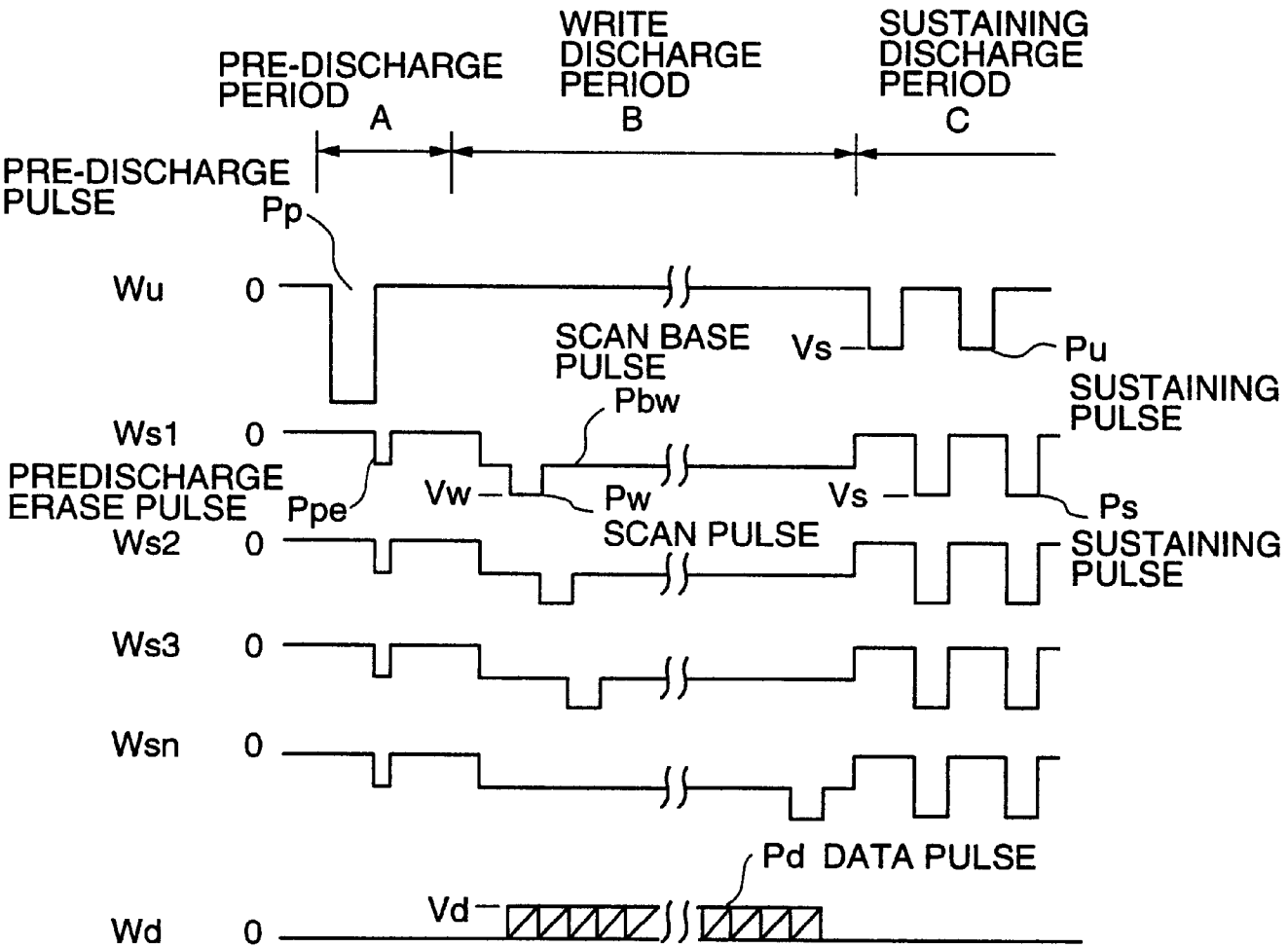
FIG. 3 shows driving waveforms representing a conventional driving method of the PDP.
Figure 4:
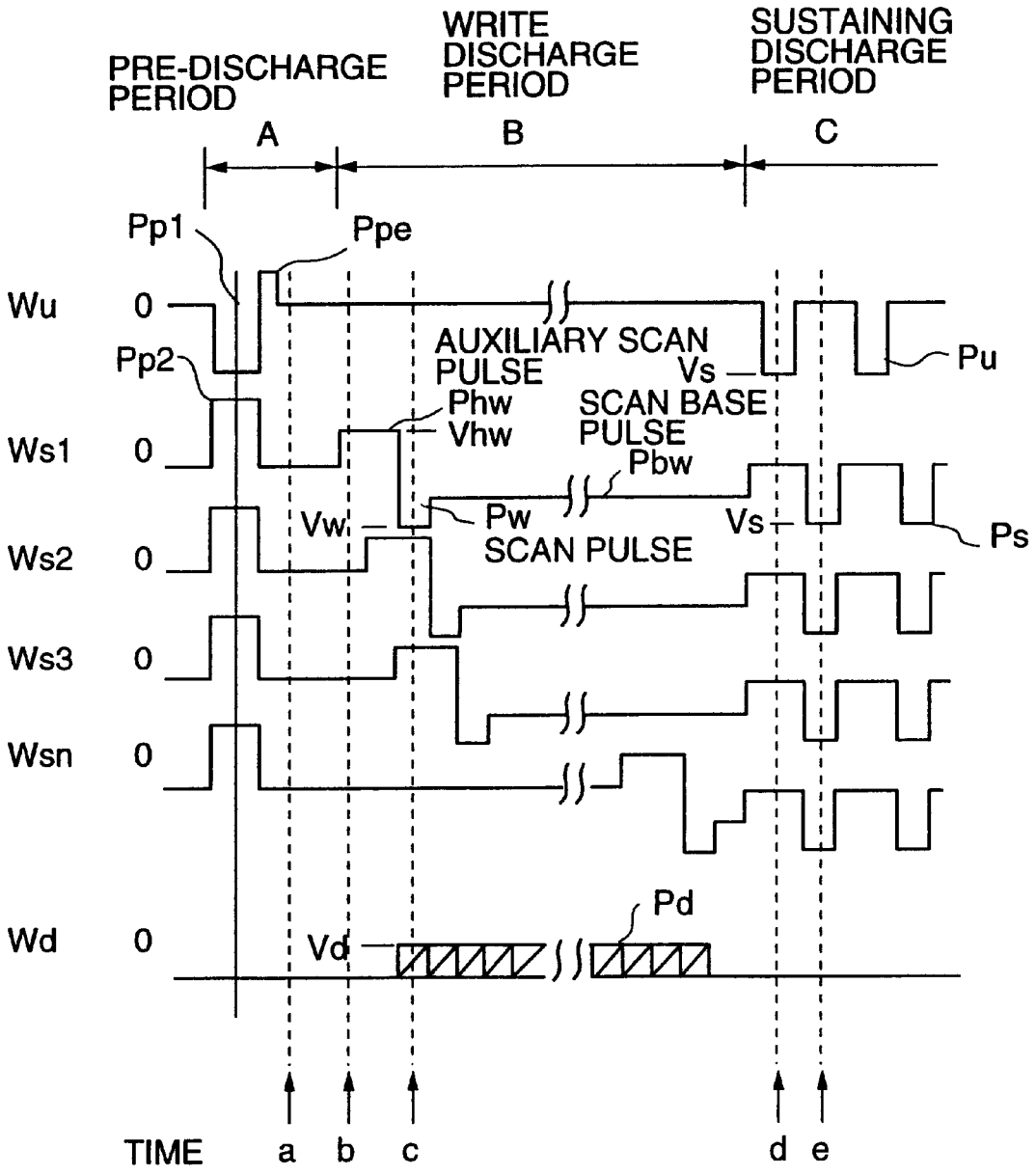
FIG. 4 shows driving waveforms representing a first driving method of the PDP according to the present invention.

FIG. 4 shows driving pulse waveforms used in a first driving method of a PDP according to the present invention. A structure of the PDP is the same as that shown in FIGS. 1 and 2.

In FIG. 4, a waveform Wu indicates a sustaining electrode driving pulse applied commonly to sustaining electrodes Su1, Su2, . . . , Sun, waveforms Ws1, Ws2, . . . , Wsn indicate scan electrode driving pulses applied to scan electrodes Sw1, Sw2, . . . , Swn, respectively, and a waveform Wd indicates a data electrode driving pulse applied to a data electrode Di ($1 \leqq i \leqq m$). One driving period (1 frame) is constructed with a pre-discharge period A, a write discharge period B and a sustaining discharge period C and a desired picture is displayed by repeating the driving period.

In the pre-discharge period A, active charged particles are produced in a discharge gas space in order to obtain a stable write discharge characteristics in the write discharge period B. In the pre-discharge period A, a pre-discharge pulse Pp1 for simultaneously discharging all of the display cells of a PDP 15 is applied to the respective sustaining electrodes and, after a pre-discharge pulse Pp2 is applied to the respective scan electrodes, a pre-discharge erase pulse Ppe for extinguishing electric charges among the wall charges produced in the pre-discharge period A, which block the write discharge and the sustaining discharge, is applied to the respective sustaining electrodes simultaneously. That is, the pre-discharge pulse Pp1 is applied to the sustaining electrodes Su1, Su2, . . . , Sun, first, and the pre-discharge pulse Pp2 is applied to the scan electrodes Sw1, Sw2, . . . , Swn, to produce discharges in all of the display cells. Thereafter, the erase pulse Ppe is applied to the sustaining electrodes Su1, Su2, . . . , Sun to produce erase discharges to thereby erase the wall charges accumulated by the pre-discharge pulse.

In the write period B, a sequential scan pulse Pw is applied to the respective scan electrodes Sw1, Sw2, . . . , Swn and a data pulse Pd is selectively applied to the data electrode Di ($1 \leqq i \leqq m$) of the display cell to be displayed, in synchronism with the scan pulse Pw, to produce a write discharge in the display cell to thereby produce the wall charges.

In the write discharge period B of the first embodiment of the driving method, an auxiliary scan pulse Phw opposite in polarity to the scan pulse Pw is applied to the scan electrodes immediately before the scan pulse Pw is sequentially applied to the respective scan electrodes. Since the auxiliary scan pulse Phw attracts space charge in such a manner that the electric field in the display cells produced by the application of voltage thereto is cancelled out, the electric field strength in the display cell is further increased when the scan pulse Pw is applied. Therefore, it produces a state in which the write discharge is easily produced, so that the stability of the write discharge is improved. Immediately after the scan pulse Pw is sequentially applied, a scan base pulse Pbw is applied to the scan electrode until an end of the write period.

In the sustaining discharge period C, sustaining discharge necessary to obtain a desired brightness of the display cells, which perform the write discharge in the write discharge period B, is repeated by applying a sustaining pulse Pu to the respective sustaining electrodes and applying an opposite sustaining pulses Ps having a phase delayed from that of the sustaining pulse Pu by 180° to the respective scan electrodes.

Figure 6:
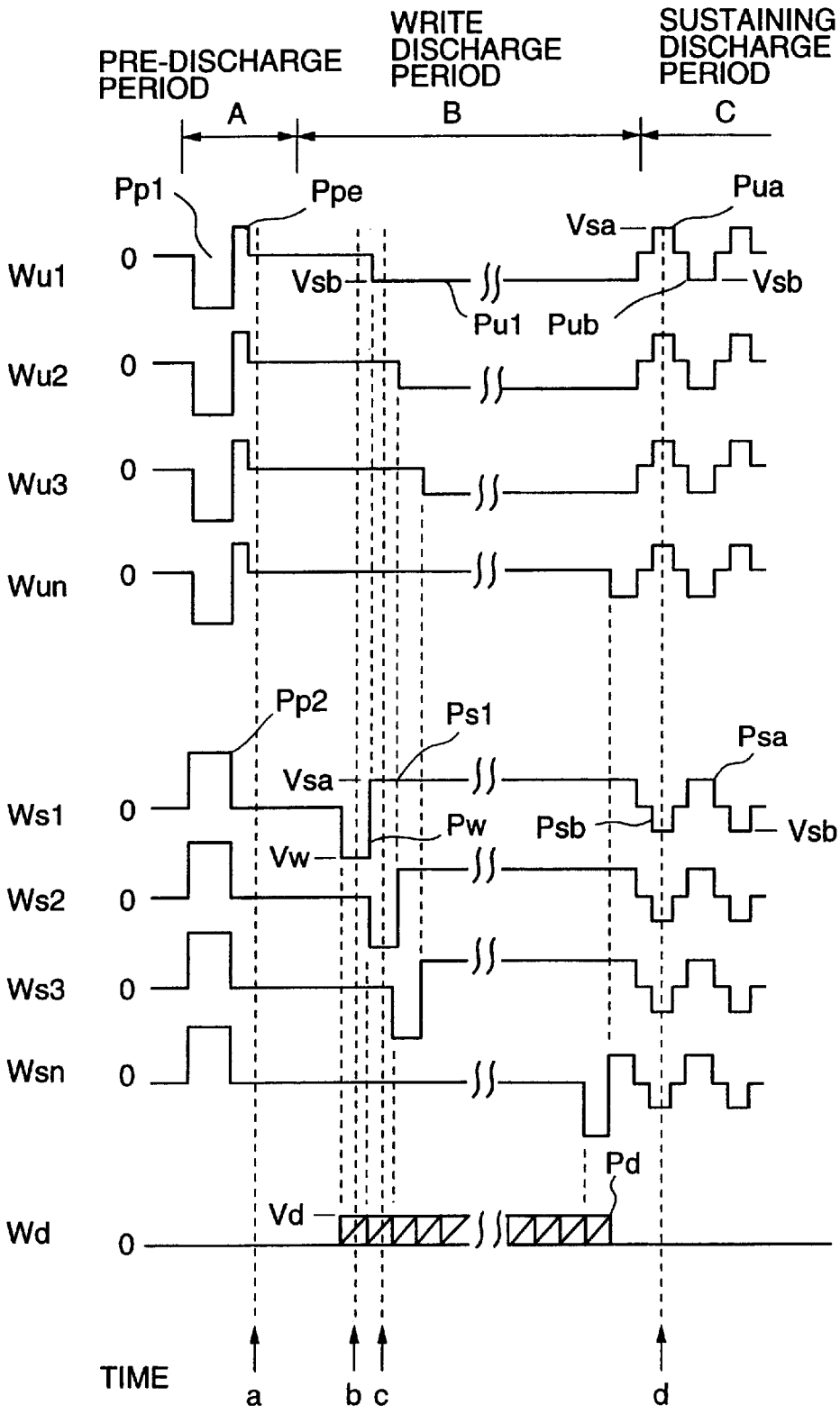
FIG. 6 shows driving waveforms representing a second driving method of the PDP according to the present invention.

Now, a second embodiment of the present invention will be described with reference to FIG. 6, in which waveforms Wu1, Wu2, . . . , Wun indicate sustaining electrode driving pulses applied to the respective sustaining electrodes Su1, Su2, . . . , Sun, waveforms Ws1, Ws2, . . . , Wsn indicate scan electrode driving pulses applied to scan electrodes Sw1, Sw2, . . . , Swn, respectively, and a waveform Wd indicates a data electrode driving pulse applied to a data electrode Di ($1 \leqq i \leqq m$). One driving period (1 frame) is constructed with a pre-discharge period A, a write discharge period B and a sustaining discharge period C and a desired picture is displayed by repeating the driving period.

In the driving method according to the second embodiment of the present invention, in the write discharge period B after the pre-discharge period A similar to that in the first embodiment, a sustaining pulse Psi is applied to the respective scan electrodes immediately after the end of the scan pulse Pw and the sustaining pulse Pu1 is supplied to the respective sustaining electrodes. The application of the sustaining pulses Ps1 and Pu1 is continued to a time point close to a start of a next sustaining pulse, which is common for all lines, in the sustaining discharge period C. In this case, since the sustaining pulses Ps1 and Pu1 are applied with the wall charge and the space charge produced by the write discharge being not extinguished substantially, the transition from the write discharge to the first sustaining discharge is improved. Further, since the sustaining voltages Vsa and Vsb are continuously applied during a time period from the first sustaining discharge to the next sustaining pulse, the holding ability of the wall charge produced by the first sustaining pulses Ps1 and Pu1 immediately after the write discharge is increased and the transition to the second sustaining pulses Psb and Psa becomes also high.

The sustaining pulses Ps1 and Pu1 are applied in an overlapping relation in time to the data pulse Pd for write discharge of other scan lines, causing an error discharge to occur. However, such error discharge can be prevented by making the sustaining pulse Ps1 and the sustaining pulse Pu1 positive and negative, respectively, and applying them to the scan electrodes and the sustaining electrodes, respectively, with voltage level of the negative sustaining pulse Pu1 opposite in polarity to the data pulse Pd being lower than the start voltage of discharge between the scan electrode and the data electrode.

The movement of the wall charges and the space charges in the write discharge period and the sustaining discharge period in the first embodiment will be described with reference to FIGS. 5(*a*) to 5(*e*), which show a variation of the movement of charges in the display cell on the head scan line taken at time instance *a* to *e* in FIG. 4.

After the pre-discharge period A ends (time instance a), the wall charges on the respective electrodes are extinguished and there are many active particles of high energy level exist in the gas discharge space. However, the distribution of the charged particles is in an equilibrium state without segregation as shown in FIG. 5(*a*).

Then, when the auxiliary scan pulse Phw is applied to the scan electrode at the time instance b, the charged particles in the gas discharge space are segregated such that the scan pulse voltage Vhw is cancelled out. That is, the population of negative charges on the side of the scan electrode 3 becomes larger and the population of positive charges on the side of the sustaining electrode 4 and the data electrode 7 becomes larger as shown in FIG. 5(*b*).

Figure 5:
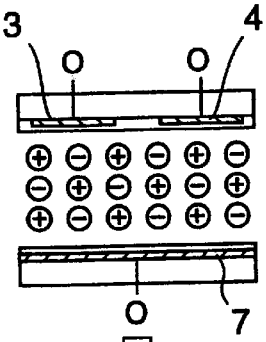
FIGS. 5(*a*) to 5(*e*) illustrate a movement of electric charges in the display cell in the driving method shown in FIG. 4.
Figure 5:
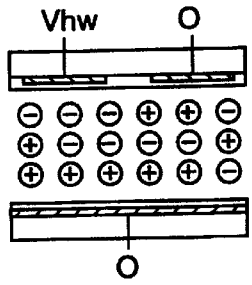
Figure 5:
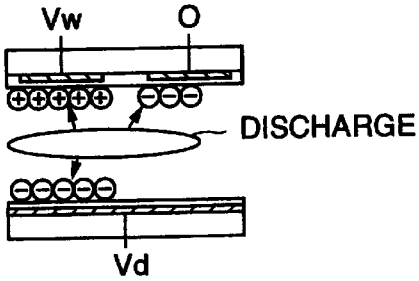
Figure 5:
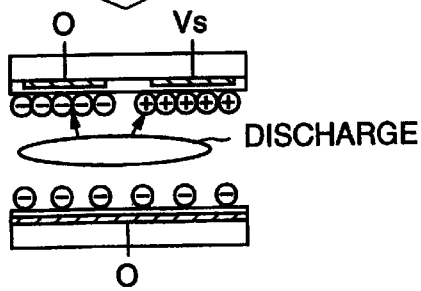
Figure 5:
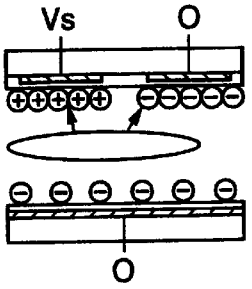

When the auxiliary scan pulse Phw is removed and simultaneously the data pulse Pd is applied (time instance c), the negative space charges are accelerated toward the sustaining electrode 4 and the data electrode 7 in the gas discharge space and the positive space charges are accelerated toward the scan electrode 3, by the electric field produced by the auxiliary scan pulse, as shown in FIG. 5(*c*). Since the distribution of the space charges at the time when the auxiliary scan pulse Phw is applied is opposite to that of charges, which tend to converge at the write discharge, an electric field produced by the distribution of the space charges is added to the electric field produced by the externally applied voltage, so that the acceleration of the charges is enhanced. Consequently, high-energy charged particles in the gas discharge space collide with each other to allow an establishment of a state in which gas discharge is easily produced.

When the write discharge occurs between the scan electrode 3 and the data electrode 7, a discharge between the scan electrode 3 and the sustaining electrode 4 is induced by the discharge between the scan electrode 3 and the data electrode 7. As a result, the positive wall charges and the negative wall charges are accumulated on the side of the scan electrode and on the side of the data electrode 7 and the sustaining electrode 4, respectively, to cancel out the externally applied voltage, as shown in FIG. 5(*c*).

The wall charges are sustained for a relatively long time after the external voltage is removed. Therefore, when the sustaining pulse Pu is applied to the sustaining electrode 4 in an initial stage (time instance d) of the sustaining discharge period, the internal voltage produced by the wall charges is added to the sustaining voltage Vs and the sustaining discharge occurs with a voltage exceeding the discharge start voltage between the scan electrode 3 and the sustaining electrode 4. With such sustaining discharge, negative wall charges and positive wall charges are accumulated on the side of the scan electrode 3 and on the side of the sustaining electrode 4, respectively, such that the sustaining voltage Vs is cancelled out, as shown in FIG. 5(*d*).

Then, when the sustaining pulse Ps is applied to the scan electrode 3 at the time instance e, a voltage opposite in polarity to the voltage produced by the preceding sustaining pulse Pu is applied between the scan electrode 3 and the sustaining electrode 4. Therefore, the internal voltage produced by the wall charges is added to the sustaining voltage Vs, so that a sustaining discharge with voltage exceeding the discharge start voltage occurs between the scan electrode 3 and the sustaining electrode 4. With such sustaining discharge, positive wall charges and negative wall charges are accumulated on the side of the scan electrode 3 and on the side of the sustaining electrode 4, respectively, such that the sustaining voltage Vs is cancelled out, as shown in FIG. 5(*e*).

By applying the sustaining pulse to the scan electrode 3 and the sustaining electrode 4 alternately, the sustaining discharge is repeated.

Figure 7:
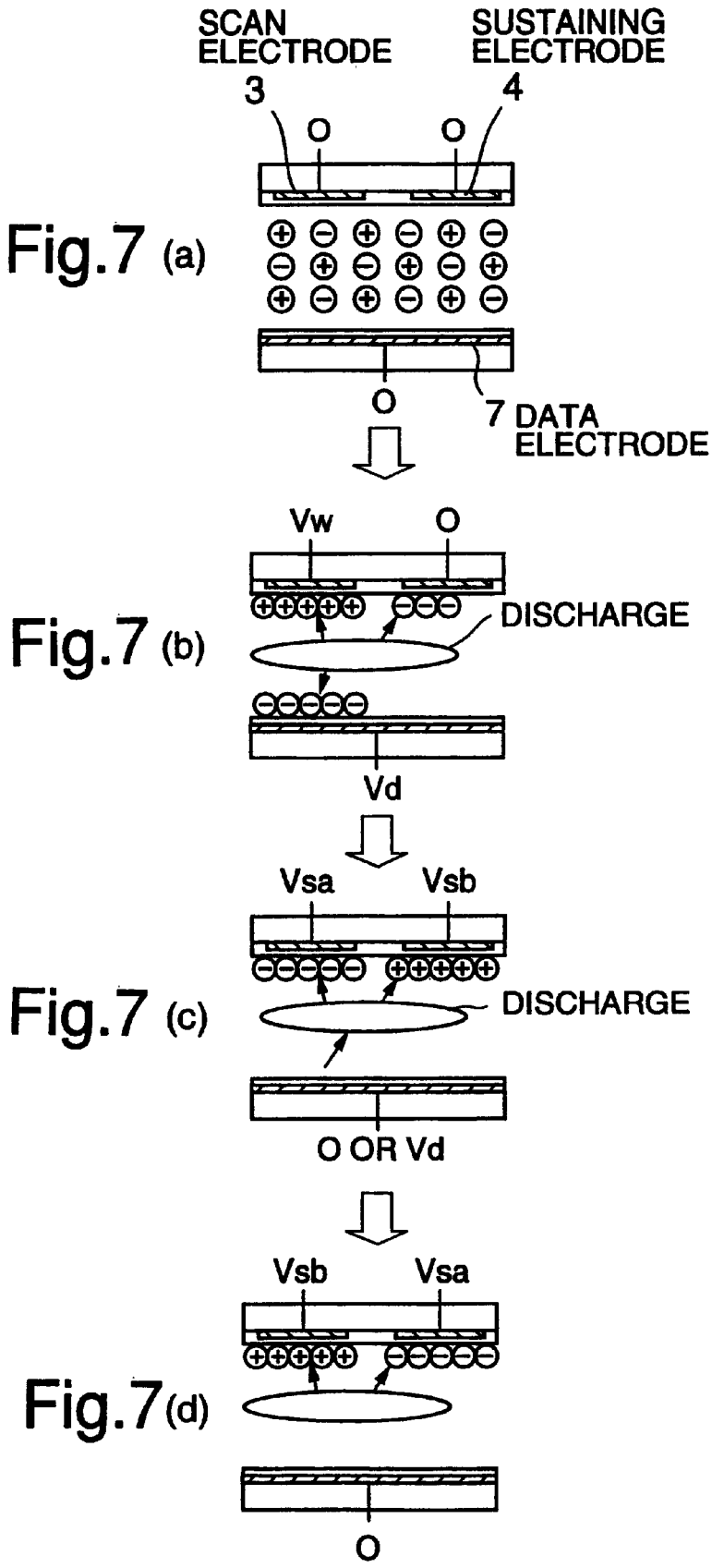
FIGS. 7(*a*) to 7(*d*) illustrate a movement of electric charges in the display cell in the driving method shown in FIG. 6.

The movement of the wall charges and the space charges in the write period and the sustaining period in the second embodiment will be described with reference to FIGS. 7(*a*) to 7(*d*), which show a variation of the movement of charges in the display cell on the head scan line taken at time instances a to e in FIG. 6.

After the pre-discharge period A ends (time instance a), the wall charges on the respective electrodes are extinguished and there are many high energy level active particles exist in the gas discharge space. However, the distribution of charged particles is in an equilibrium state without segregation as shown in FIG. 7(*a*).

Then, when the scan pulse Pw and the data pulse Pd corresponding thereto are applied to the scan electrode 3 and the data electrode 7 at the time instance b, a write discharge occurs between the scan electrode 3 and the data electrode 7. A discharge between the scan electrode 3 and the sustaining electrode 4 is induced by the discharge between the scan electrode 3 and the data electrode 7. As a result, the positive wall charges and the negative wall charges are accumulated on the side of the scan electrode 3 and on the side of the data electrode 7 and the sustaining electrode 4, respectively, to cancel out the externally applied voltage, as shown in FIG. 7(*b*).

When a positive sustaining pulse Ps1 and a negative sustaining pulse Pu1 are applied to the scan electrode 3 and the sustaining electrode 4, respectively, at the end of the scan pulse Pw (time instance c), the wall charges produced by the write discharge are added to these sustaining pulse voltages and a discharge occurs with voltage exceeding the discharge start voltage between the scan electrode 3 and the sustaining electrode 4. Since a time interval between the write discharge and a first sustaining discharge is very small immediately before the occurrence of this sustaining discharge, attenuation of the wall charge produced by the write discharge is very small and the amount of high energy active particles in the gas discharge space is large. Therefore, the transition from the write discharge to the first sustaining discharge becomes very smooth.

In this embodiment, the first sustaining pulses Ps1 and Pu1 are applied to the scan electrode 3 and the sustaining electrode 4, respectively, at the end of the write discharge. However, it is possible to apply these first sustaining pulses to the scan electrode 3 and the sustaining electrode 4 at a time after the end of the write discharge, provided that the time is shorter than 100 $\mu$s, preferably, shorter than 20 $\mu$s, with substantially the same effect as that obtainable by the simultaneous application of these first sustaining pulses, as shown in FIG. 7(*c*).

These first sustaining pulses Ps1 and Pu1 are applied continuously until a time immediately before the start of second sustaining pulses Psb and Pua, which are common for all lines. Although the wall charge is reduced with time due to recombination with space charge, it is possible to substantially reduce the reduction rate of wall charge by applying a voltage high enough to continuously attract charges to the wall. The wall charge produced by the first sustaining discharge functions to cancel the head sustaining pulse voltages and, therefore, the sustaining voltages act as a wall charge holding voltage after the discharge is ended. Therefore, it is possible to make the transition from the first sustaining pulses to the second sustaining pulses Psb and Pua smooth, so that the sustaining discharge by the second sustaining pulses is reliably produced stably at the time instance d. The time from the end of the first sustaining pulses to the start of the second sustaining pulses is preferably shorter than 100 $\mu$s and, particularly, shorter than 20 $\mu$s (FIG. 7(*d*)).

Although the first sustaining pulses Ps1 and Pu1 overlap in time with the data pulse Pd for write of the subsequent scan line, it is possible to prevent error discharge between data pulses for other scan lines from occurring by suitably setting voltage values of the positive sustaining pulse Ps1 and the negative sustaining pulse Pu1. In order to restrict error discharge, it is enough that a sum of the voltage level Vsb of the sustaining pulse Pu1 and the voltage level Vd of the data pulse Pd is made smaller than a discharge start voltage Vfud between the sustaining electrode and the data electrode and, further, a sum of the voltage level Vsa of the sustaining pulse Ps1 and the voltage level Vsb of the sustaining pulse Pu1 is made larger than a minimum sustaining voltage Vssu between the scan electrode and the sustaining electrode and smaller than a discharge start voltage Vfsu when there is no write discharge.

For example, assuming that the discharge start voltage Vfud between the sustaining electrode and the data electrode is 190V, the minimum sustaining voltage Vssu between the scan electrode and the sustaining electrode is 160V and the discharge start voltage Vfsu between the scan electrode and the sustaining electrode without write discharge is 200V, it may be Vsa=90V, Vsb=90V and Vd=60V. That is, Vfud (190V)>Vsb (90V)+Vd (60V)

Vfsu (200V)>Vsa (90V)+Vsb (90V)>Vssu (160V).

In the driving method according to the second embodiment of the present invention, the second and subsequent sustaining pulses Psa, Psb, Pua and Pub are common for all scan lines, in order to facilitate controls of the number of sustaining pulses and the termination of sustaining discharge (erase operation). The reason for this is that, if a sustaining operation common for all lines is desired, a single sustaining pulse generator circuit can be used for the second and subsequent sustaining pulses and, in order to obtain a desired brightness, it is enough to control the number of pulse generations of the single sustaining pulse generator circuit. For the termination of sustaining discharge, it is necessary to produce an erase discharge. However, if the last sustaining pulse is applied to all scan lines simultaneously, it is possible to terminate discharges for all scan lines simultaneously by generating an erase pulse by a single erase pulse generator circuit subsequently to the application of the last sustaining pulse. Therefore, it becomes possible to reduce the number of circuits, so that it becomes possible to constitute a driving circuit in a relatively small area to thereby improve the space factor.

Figure 8:
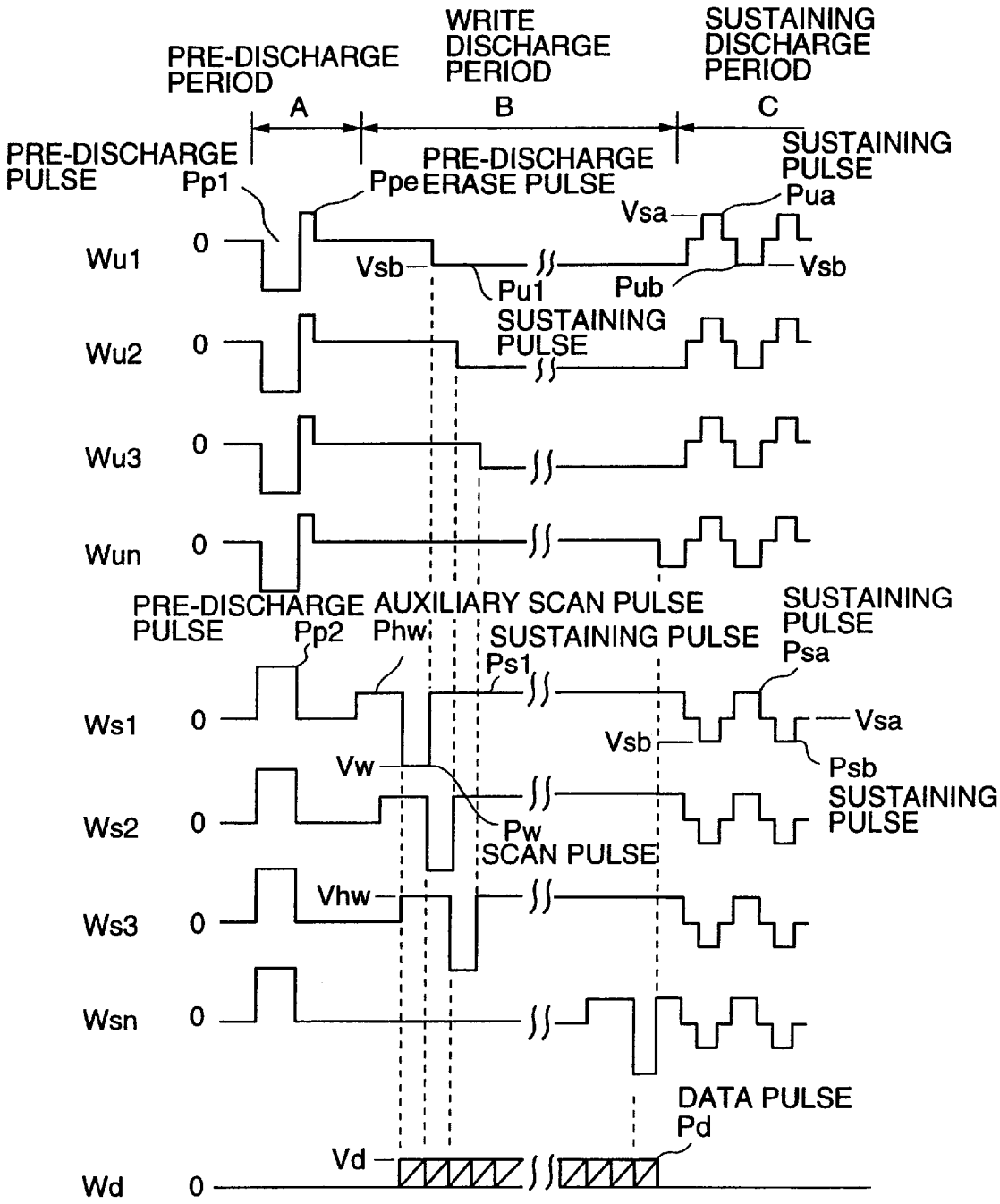
FIG. 8 shows driving waveforms representing a third driving method of the PDP according to the present invention.

Now, a third embodiment of the present invention will be described with reference to FIG. 8, which shows a combination of the first and second driving methods. In FIG. 8, waveforms Wu1, Wu2, . . . , Wun indicate sustaining electrode driving pulses supplied to the respective sustaining electrodes Su1, Su2, . . . , Sun, waveforms Ws1, Ws2, . . . , Wsn indicate scan electrode driving pulses supplied to scan electrodes Sw1, Sw2, . . . , Swn, respectively, and a waveform Wd indicates a data electrode driving pulse supplied to a data electrode Di ($1 \leqq i \leqq m$). One driving period (1 frame) is constructed with a pre-discharge period A, a write discharge period B and a sustaining discharge period C and a desired picture is displayed by repeating the driving period.

In the driving method according to the third embodiment of the present invention, in the write discharge period B, the auxiliary scan pulse Phw opposite in polarity to the scan pulse Pw is applied to the respective scan electrodes before the scan pulse Pw is sequentially applied to the scan electrodes and, further, the positive sustaining pulse Ps1 and the negative sustaining pulse Pu1 are supplied to the scan electrodes and the sustaining electrodes, respectively, simultaneously with the end of the scan pulse Pw. The application of the sustaining pulses Ps1 and Pu1 is continued to the time point close to the start of a next sustaining pulse.

According to this method, the write discharge is stabilized by the auxiliary scan pulse Phw and the transition of the sustaining discharge is smoothed by the first sustaining pulses Ps1 and Pu1. Therefore, it is possible to make a driving voltage range wider.

Figure 9:
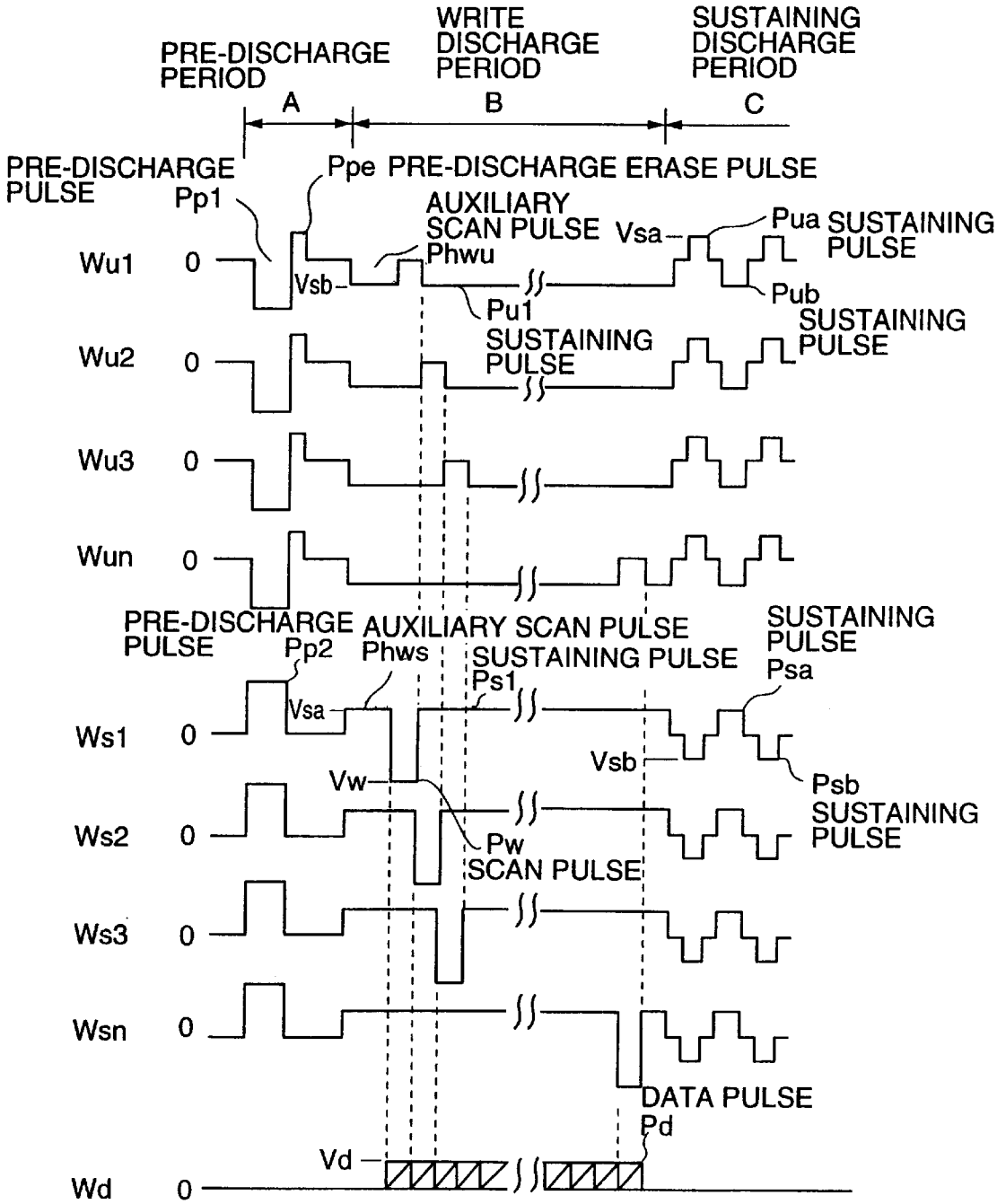
FIG. 9 shows other driving waveforms representing the third driving method of the PDP according to the present invention.

Waveforms shown in FIG. 9 shows another example of the embodiment, which is a combination of the first and second driving methods. In the embodiment shown in FIG. 9, the auxiliary scan pulse includes a positive pulse Phws and a negative pulse Phwu, which are applied to the scan electrode and the sustaining electrode, respectively. Further, start points of these auxiliary scan pulses are the same for all scan electrodes and sustaining electrodes and voltages of the auxiliary scan pulses Phws and Phwu are made equal to the voltages Vsa and Vsb of the sustaining pulses Ps1 and Pu1, respectively. Therefore, the driving circuit for the auxiliary scan pulse can be used commonly for the sustaining pulse, enabling a reduction of the number of circuits.

In each of the described embodiments, the pre-discharge period is arranged immediately before the write discharge period. However, it is not always necessary to put the pre-discharge period immediately before the write discharge period. That is, there may be a time gap between the pre-discharge period and the write discharge period, provided that the effect of the pre-discharge can be obtained.

Further, it may be possible to combine the write discharge period B and the sustaining discharge period C as a unit (field) and to insert the pre-discharge period A into every predetermined number of units.

As described hereinbefore, in the first driving method of the plasma display panel of matrix type, according to the first embodiment of the present invention, the auxiliary scan pulse opposite in polarity to the scan pulse is applied to the scan electrode immediately before the scan pulse is applied thereto, so that the probability of occurrence of the state in which gas discharge, that is, the write discharge, can be produced easily, becomes high. Therefore, variation of discharge delay time is reduced and, therefore, it becomes possible to reduce a time necessary for the write operation for each scan line. Accordingly, it becomes possible to drive a larger number of scan lines within a constant time to thereby realize a display device having a larger display capacity.

In the second method of the present invention, the sustaining pulse is applied immediately after the write discharge and the sustaining pulse is kept maintained until a time close to a start time of a next sustaining pulse. Therefore, the transition from the write discharge to a first sustaining discharge becomes smooth and the transition from the first sustaining discharge to a second sustaining discharge becomes smooth. Consequently, it becomes possible to start the sustaining discharge even with low sustaining voltage to thereby obtain a wide driving voltage range.

What is claimed is:

1. A method of driving, during a write discharge period, a matrix type plasma display panel having a plurality of display cells, said panel additionally comprising; a plurality of row electrode pairs, each said row electrode pair comprising a scan electrode and a sustaining electrode, said panel additionally comprising a plurality of data electrodes perpendicular to said row electrode pairs, said method comprising:

applying a composite scan pulse sequentially to said scan electrodes, said composite scan pulse comprising a first non-zero voltage level for a first predetermined time interval, followed by a second non-zero voltage for a second predetermined time interval, said second non-zero voltage being different from said first non-zero voltage level, followed by a third non-zero voltage level, said third non-zero voltage level being different from both said first non-zero voltage level and said second non-zero voltage level, wherein said composite scan pulse comprises an auxiliary scan pulse as said first non-zero voltage level opposite in polarity to said second non-zero voltage level, said second level comprising a scan pulse, and wherein a data pulse is selectively supplied to said data electrodes in synchronism with said scan pulse.

2. A method of driving, during a write discharge period, a matrix type plasma display panel having a plurality of display cells, said panel additionally comprising a plurality of row electrode pairs, each said row electrode pair comprising a scan electrode and a sustaining electrode, said panel additionally comprising a plurality of data electrodes perpendicular to said row electrode pairs, said method comprising:

preceding an application of a scan pulse, applying to said scan electrodes a pulse different from a scan pulse; and applying immediately afterwards to said scan electrodes the said scan pulse, wherein said application of said pulse different from a scan pulse followed by said scan pulse is done sequentially to each of said scan electrodes, wherein said scan pulse is sequentially applied to said scan electrodes while selectively applying a data pulse to said data electrodes in synchronism with said scan pulse, wherein a first sustaining pulse is sequentially supplied to said scan electrodes and an opposite sustaining pulse opposite in polarity to said first sustaining pulse to said sustaining electrodes, immediately after said scan pulse is applied to said scan electrodes, and wherein the application of said first and opposite sustaining pulses is continued to a time close to a start of a second sustaining pulse.

3. A method of driving, during a write discharge period, a matrix type plasma display panel having a plurality of display cells, said panel additionally comprising a plurality of row electrode pairs, each said row electrode pair comprising a scan electrode and a sustaining electrode, said panel additionally comprising a plurality of data electrodes perpendicular to said row electrode pairs, said method comprising:

preceding an application of a scan pulse, applying to said scan electrodes a pulse different from a scan pulse; and applying immediately afterwards to said scan electrodes the said scan pulse, wherein said application of said pulse different from a scan pulse followed by said scan pulse is done sequentially to each of said scan electrodes, wherein said pulse different from said sequential scan pulse is an auxiliary scan pulse opposite in polarity to said sequential scan pulse and is sequentially applied to said scan electrodes immediately before said sequential scan pulse is sequentially applied to said scan electrodes, wherein a data pulse is selectively applied to said data electrodes while applying said sequential scan pulse to said scan electrodes, wherein a first sustaining pulse is sequentially applied to said scan electrodes and an opposite sustaining pulse opposite in polarity to said first sustaining pulse to said sustaining electrodes, immediately after said scan pulse is applied to said scan electrodes, and wherein the application of said first and opposite sustaining pulses is continued throughout the remainder of said write discharge period.

4. A method of driving, during a write discharge period, a matrix type plasma display panel having a plurality of display cells, said panel additionally comprising a plurality of row electrode pairs, each said row electrode pair comprising a scan electrode and a sustaining electrode, said panel additionally comprising a plurality of data electrodes perpendicular to said row electrode pairs, said method comprising:

applying an auxiliary scan pulse opposite in polarity to a sequential scan pulse to said scan electrodes immediately before said sequential scan pulse is applied to said scan electrode and applying another auxiliary scan pulse opposite in polarity to said auxiliary scan pulse to said sustaining electrodes, selectively applying a data pulse to said data electrodes in synchronism with the application of said sequential scan pulse to said scan electrodes, sequentially applying a sustaining pulse to said scan electrodes immediately after the application of said scan pulse to said scan electrodes and sequentially applying a sustaining pulse opposite in polarity to said sustaining pulse to said sustaining electrodes, and continuing the application of said sustaining pulse to said scan electrodes and of said opposite sustaining pulse opposite in polarity to said sustaining pulse to said sustaining electrodes to a time close to a start of a second sustaining pulse.

5. The method of claim 2, wherein a sum of a voltage level of said sustaining pulse applied to said sustaining electrodes and a voltage level of said data pulse applied to said data electrodes is set smaller than a discharge start voltage between said sustaining electrode and said data electrode.

6. The method of claim 2, wherein a sum of a voltage level of said sustaining pulse applied to said sustaining electrodes and a voltage level of said data pulse applied to said data electrodes is set larger than a minimum sustaining voltage between said scan electrodes and said sustaining electrodes and smaller than a discharge start voltage therebetween without write discharge.

7. The method of claim 2, wherein a second or subsequent sustaining pulse is applied simultaneously to all of said scan lines subsequently to the application of said first sustaining pulse and said opposite sustaining pulse applied to said scan electrodes and said sustaining electrodes.

8. The method of claim 4, wherein said auxiliary scan pulse applied to said scan electrodes and said sustaining electrodes is simultaneously applied to all of said scan electrodes and all of said sustaining electrodes.

9. The method of claim 4, wherein a voltage value of said auxiliary scan pulse is set equal to a voltage value of said sustaining pulse.

10. A method of driving, during a write discharge period, a plasma display panel including at least one display cell that includes a scan electrode and a sustaining electrode, said method comprising:

prior to a scan pulse, applying an auxiliary pulse to said scan electrode such that an electric field strength in said display cell is increased, said auxiliary pulse having a first voltage level and a scan pulse having a second voltage level that is opposite in polarity to said first voltage level;

applying said scan pulse to said first voltage level to said scan electrode while the increased electric field strength in said display cell is maintained;

after applying said second voltage level, applying a third voltage level opposite in polarity to said second voltage level to said scan electrode; and applying a fifth voltage level opposite in polarity to said first voltage level applied to said sustaining electrode when said first voltage level is applied.

11. A method of driving, during a write discharge period, a plasma display panel including at least one display cell that Includes a scan electrode, a sustaining electrode, and a data electrode, said method comprising:

applying a scan pulse to said scan electrode, said scan pulse having a first voltage level; and applying a second voltage level opposite in polarity to said first voltage level to said scan electrode, said second voltage level following said first voltage level, wherein a third voltage level opposite in polarity to said second voltage level is applied to said sustaining electrode when said second voltage level is applied to said scan electrode.

12. The method as claimed in claim 11, wherein said second and third levels are maintained until sustaining pulses are applied to said sustaining and scan electrodes.

13. The method as claimed in claim 12, wherein said second voltage level is substantially identical to one of highest and lowest voltage levels of said sustaining pulse.

14. The method as claimed in claim 13, wherein said third voltage level is substantially identical to the other of said highest and lowest voltage levels of said sustaining pulse.

15. The method as claimed in claim 11, further comprising:

before applying said first voltage level, applying a fourth voltage level opposite in polarity to said first voltage level to said scan electrode.

16. The method as claimed in claim 15, wherein said fourth voltage level is substantially identical to said first voltage level.

17. The method as claimed in claim 15, wherein when said fourth voltage level is applied to said scan electrode, a fifth voltage level opposite in polarity to said fourth voltage level is applied to said sustaining electrode.

18. The method as claimed in claim 17, wherein said fifth voltage level is substantially identical to said first voltage level.

* * * * *